US005413747A

United States Patent [19]

Akers et al.

[11] Patent Number: 5,413,747

[45] Date of Patent: May 9, 1995

[54] WATER ABSORBENT FIBRES

[75] Inventors: Paul J. Akers, Coventry; William Brunskill, Hinckley, both of United Kingdom

[73] Assignee: Courtaulds Fibres (Holdings) Limited, United Kingdom

[21] Appl. No.: 133,157

[22] PCT Filed: Apr. 24, 1992

[86] PCT No.: PCT/GB92/00765

§ 371 Date: Oct. 14, 1993

§ 102(e) Date: Oct. 14, 1993

[87] PCT Pub. No.: WO92/19799

PCT Pub. Date: Nov. 12, 1992

[30] Foreign Application Priority Data

Apr. 26, 1991 [GB] United Kingdom ..... 9108942

[51] Int. Cl.[6] ..... D01F 1/02

[52] U.S. Cl. ..... 264/211; 264/205; 604/366

[58] Field of Search ..... 264/205, 211.2, 211.18, 264/177.2, 211.17, 211, 211.16; 524/832, 834, 787, 789, 791

[56] References Cited

U.S. PATENT DOCUMENTS

| | | | |
|---|---|---|---|
| 2,956,329 | 10/1960 | Touey . | |
| 3,458,616 | 7/1969 | Guess et al. | 264/205 |
| 4,305,901 | 12/1981 | Prince et al. | 264/211.2 |
| 4,587,308 | 5/1986 | Makita et al. | 525/373 |
| 4,861,539 | 8/1989 | Allen et al. | 264/205 |
| 4,977,192 | 12/1990 | Martineu et al. . | |
| 4,997,714 | 3/1991 | Farrar | 264/205 |
| 5,229,488 | 7/1993 | Nagasuna et al. | 524/450 |

FOREIGN PATENT DOCUMENTS

| | | |
|---|---|---|
| 268498 | 5/1988 | European Pat. Off. . |
| 0269393 | 6/1988 | European Pat. Off. . |
| 342919 | 11/1989 | European Pat. Off. . |
| 0397410 | 11/1990 | European Pat. Off. . |
| 2559158 | 8/1985 | France . |
| 63-210109 | 8/1988 | Japan . |
| 2082614 | 3/1982 | United Kingdom . |
| WO81/01856 | 7/1981 | WIPO . |

*Primary Examiner*—Veronica P. Hoke
*Attorney, Agent, or Firm*—Howson and Howson

[57] ABSTRACT

Fibres and filaments of water-absorbent water-insoluble fibrous material have a matrix of a crosslinked copolymer formed from 50 to 95% by weight of ethylenically unsaturated carboxylic monomer and 5 to 50% by weight of copolymerisable ethylenically unsaturated monomer. The matrix contains dispersed solid water-insoluble particles of a material which is chemically substantially non-reactive with the matrix copolymer.

13 Claims, No Drawings

WATER ABSORBENT FIBRES

TECHNICAL FIELD

This invention relates to fibres or filaments, and it has particular reference to fibres or filaments of water-absorbent water-insoluble material.

Water-absorbent water-insoluble materials are of use in many absorbent products, particularly in products for absorbing aqueous body fluids, such as baby diapers, incontinence pads, sanitary napkins and tampons, and in wiping materials for mopping up spills of aqueous fluids. Most water-absorbent water-insoluble materials are only available in powder form. There are problems in retaining an absorbent powder in the desired position in the absorbent product, for example in diapers. Fibres and filaments can be more effectively retained in position by incorporating them in a fabric.

BACKGROUND ART

EP-A-268498 describes a water-absorbent water-insoluble polymeric fibre, film, coating, bonding layer or foam, made by forming a substantially linear polymer of water-soluble ethylenically unsaturated monomer blends comprising carboxylic and hydroxylic monomers and then reacting the carboxylic and hydroxylic monomers in the linear polymer to form internal cross-links within the polymer.

EP-A-269393 describes a water-absorbent, water-insoluble crosslinked polymer fibre or film made by dry extrusion of a solution of a substantially linear polymer formed from a water-soluble blend of monoethylenically unsaturated monomers comprising a plasticising monomer and evaporating the solvent. The fibre or film is further plasticised, stretched and then crosslinked.

EP-A-342919 describes film or fibre made by extrusion and stretching from a polymer of water-soluble ethylenically unsaturated monomers that include ionic monomer. A counterionic lubricant compound is absorbed into the surface of the fibre or film before or during the stretching.

EP-A-397410 describes a water-soluble linear polymer of carboxylic acid monomers such as acrylic acid and a hydroxylic monomer which can be crosslinked, after being shaped by extrusion of an aqueous solution of the polymer as fibres or films, to form crosslinks between the carboxyl and hydroxyl groups.

GB-A-2082614 describes a dry, solid, water-swellable absorbent comprising a blend of a water-insoluble absorbent polymer, which may be a covalently cross-linked or ionically complexed anionic polyelectrolyte, and an extender material selected from uncrosslinked derivatives, starch, montmorillonite clay, attapulgite clay, seracite, talc, kaolin, silica and mixtures thereof. It states that the blend may be used as a film, aerated film, powder or fibre, but there is no disclosure as to how a blend of water-insoluble polymer and extender can be made into a fibre.

DISCLOSURE OF THE INVENTION

According to the present invention a fibre or filament of a water-absorbent water-insoluble fibrous material has a matrix of a crosslinked copolymer formed from 50 to 95% by weight of ethylenically unsaturated carboxylic monomer and 5 to 50% by weight of copolymerisable ethylenically unsaturated monomer, the matrix containing dispersed solid water-insoluble particles of a material which is chemically substantially non-reactive with the matrix copolymer.

The dispersed solid particles are generally chosen to improve the properties of the fibre or filament; for example they may modify the absorption/retention characteristics of the fibre or filament, alter the bulk properties of the fibre or filament such as its electrical conductivity or X-ray capacity, or alter the ability of the fibre or filament to absorb chemicals.

The dispersed particles are preferably less than 20 microns in diameter, most preferably less than 5 microns.

The dispersed solid particles may be formed of inorganic salts or oxides or naturally occurring mineral clays, or of any other substantially water-insoluble solids that can be reduced in particle size to a sufficient degree and are chemically substantially non-reactive towards the matrix copolymer.

The fibre or filament may be formed by extruding a dispersion of the solid water-insoluble particles in an aqueous solution of the matrix copolymer in its non-crosslinked state through a spinneret into a gaseous environment to remove the water to form a fibre or filament, and subsequently crosslinking the copolymer.

The fibre or filament may be stretched subsequent to formation, preferably before the crosslinking system is activated.

Although the crosslinking system can be a system that is activated by irradiation, for instance ultraviolet light, preferably it is a thermally activated system, in which event the rate of crosslinking at the temperatures prevailing during the stretching and earlier stages of the process should be such that there is substantially no crosslinking during these stages. By this means it is possible to optimise the stretching of the fibre or filament while the polymer is linear and then to fix the polymer in its stretched configuration by crosslinking.

As a rule, the non-crosslinked polymer is substantially linear and is formed from a water-soluble blend of monoethylenically unsaturated monomers that must be selected such that the final crosslinked polymer is water-absorbent. Ways of selecting monomers for this purpose are known, for example from EP-A-397410 mentioned above. Generally, the water-soluble blend of monoethylenically unsaturated monomers is an anionic blend and it optionally comprises a non-ionic monomer with the carboxylic acid monomer. The monomers used in the invention may be allylic but are generally vinylic, most preferably acrylic, monomers.

Preferred carboxylic monomers are methacrylic acid or acrylic acid, but maleic acid or anhydride, iraconic acid or any of the other conventional ethylenically unsaturated carboxylic acids or anhydrides are also suitable. The copolymer can optionally additionally contain monomer units derived from an ethylenically unsaturated sulphonic acid such as 2-acrylamido-2-methylpropane sulphonic acid or allyl sulphonic acid. Carboxylic and sulphonic monomers may be present in the final polymer in free acid or water-soluble salt form, suitable salts being formed with ammonia, an amine or an alkali metal. The proportion of salt and free acid groups can be adjusted after formation of the cross-linked polymer or after polymerisation of the linear polymer or before polymerisation. Generally, the molar ratio of free carboxylic acid groups to alkali metal or other carboxylate salt groups in the final polymer (and often also in the monomers that are used to form the linear polymer) is from 1:1 to 1:10. The ratio is usually at least 1:2 and often 1:3. It is usually below 1:6 and often below 1:5.

When the crosslinking reaction involves reaction with the carboxylic acid groups it is usually preferred that at least some of the carboxylic acid groups should be present as free acid groups before the crosslinking occurs. For instance, for this purpose, it may be adequate for 10 to 75%, preferably 25 to 75%, of the acid groups to be in free acid form before the crosslinking occurs.

Although the linear polymer is generally made by polymerisation of carboxylic acid monomer (in free acid or salt form), it is also possible to make the polymer by polymerisation of monomer that can be subsequently reacted to form the carboxylic acid monomer. For instance the carboxylic acid groups that are to be present (in free acid or salt form) in the crosslinked monomer may be present initially in the linear polymer in the form of hydrolysable ester groups, such as methyl ester groups, that can then be hydrolysed while in the form of a linear polymer to yield carboxylic acid (free acid or salt) groups.

The copolymerisabie ethylenically unsaturated monomer may be a water-soluble ethylenically unsaturated monomer such as acrylamide or may be a water-insoluble monomer. One or more copolymerisable monomers may be present. A monomer that will provide groups for internal crosslinking with the carboxylic groups (as discussed below) is usually included. The copolymerisable monomer may comprise an olefin, such as isobutylene (for instance for copolymerisation with maleic acid or anhydride), and/or the monomer may be a plasticising monomer, that is to say a monomer which results in the final polymer being more flexible and plasticised than it would be if the plasticising monomer had been replaced by a corresponding amount of the main anionic monomer that is in the polymer.

Suitable plasticising monomers include aromatic ethylenically unsaturated monomers, such as acrylonitrile or styrenes (e.g. styrene or a substituted styrene), but they are preferably alkyl esters of acrylic or methacrylic acid or of another suitable unsaturated carboxylic acid. Vinyl acetate and other vinyl esters may be used. The alkyl group of the ester generally contains less than 24 carbon atoms and usually 2 or more. Preferred alkyl groups contain 1 to 10 carbon atoms, especially ethyl and also higher alkyl groups such as 2-ethylhexyl or other $C_6$-$C_{10}$ alkyl groups. Particularly preferred plasticising monomers are methyl or ethyl acrylate or methacrylate, butyl acrylate or methacrylate and 2-ethyl hexyl acrylate or methacrylate. They are generally present in amounts of at least 2% and preferably at least 10% by weight based on the monomers used for forming the copolymer, because lower amounts tend to give inadequate benefit. The amount is below 50%, and generally below 45%, by weight.

Other non-ionic monomers that may be used include ethylenically unsaturated monomers that carry a pendent group of the formula $—A_mB_nA_pR$ where B is ethyleneoxy, n is an integer of at least 2, A is propyleneoxy or butyleneoxy, m and p are each an integer less than n and preferably below 2 and most preferably zero, and R is a hydrophobic group containing at least 8 carbon atoms. R is usually a hydrocarbon group, for instance alkyl, aryl, aralkyl, alkaryl or cycloalkyl. The use of 1 to 50% by weight, generally 5 to 30% by weight, of such monomers can give plasticisation and can give improved adsorptive capacity and non-tackiness, especially in aqueous electrolytes. For a full description of suitable values of A, B, R n, m and p, reference should be made to EP-A-213799.

Hydroxyalkyl esters of ethylenically unsaturated carboxylic acids, such as hydroxyalkyl methacrylates or acrylates, can also be included as plasticising monomer. For optimum plasticisation the hydroxyalkyl group contains at least 6 carbon atoms, for instance 6 to 10 carbon atoms. These monomers may be used, as plasticising monomers, in place of an equivalent amount of alkyl methacrylate or acrylate but, as explained below, the hydroxyalkyl methacrylate can also be present to serve as internal crosslinking agent.

The substantially linear water-soluble copolymer may be formed from the monomer blend in any conventional manner. It may be preformed and then dissolved to form a polymer solution. For instance, it may be made by reverse-phase polymerisation if the monomer blend is soluble in water or by water-in-oil emulsion polymerisation if the blend is insoluble in water, e.g. at a low pH. However, this can incur the risk that the polymer may be contaminated by surfactant and this is undesirable. Preferably, therefore, the polymer is made by aqueous solution polymerisation or other solution polymerisation methods. It may be dried before further processing, but preferably not. Generally, it is formed by solution polymerisation in the solvent in which is it to be extruded (generally water).

The polymerisation can be conducted in a conventional manner in the presence of conventional initiators and/or chain-transfer agents to give the desired molecular weight.

The concentration of polymer in the solution to be passed through the spinneret is generally in the range 5 to 50% by weight and will be selected, having regard to the molecular weight of the polymer, so as to give a solution having a viscosity that is convenient for extrusion. The spinneret can be of the type conventionally used in synthetic fibre production. The concentration of polymer is usually at least 15% by weight, with values of 30% to 45%, e.g. 35% to 40%, by weight often being particularly suitable.

The solution that is extruded may have a viscosity as low as, for instance, 20,000 mPa.s at 20° C. but generally the viscosity is at least 70,000 and usually at least 100,000 and sometimes at least 120,000 mPa.s . It can be up to 150,000 or even 200,000 mPa.s. Higher values are generally unnecessary. All these viscosities are measured at 20° C. using a Brookfield RVT spindle 7 at 20 rpm. The viscosity desirably is also relatively high at the extrusion (spinning) temperature, which typically is elevated, for instance above 80° C. but below the boiling point of the copolymer solution. Preferably therefore the solution at 80° C. has a viscosity of at least 5,000 or 10,000 mPa.s and most preferably at least 20,000 mPa.s. For instance it may be in the range 50,000 to 100,000 mPa.s. These values may be obtained by extrapolation from values obtained using a Brookfield RVT viscometer spindle 7 at 20 rpm at a range of temperatures somewhat below 80° C.

The molecular weight of the linear polymer that is extruded may be as low as, for instance, 50,000 or 100,000 but preferably is above 300,000 and most preferably is above 500,000. For instance, it may be up to 1 million or higher.

The solvent of the solution that is extruded is generally water but can be methanol or other suitable organic solvent or may be a blend of water and organic solvent.

The solvent must be volatile so as to permit rapid evaporation after extrusion. The gaseous environment into which the solution is extruded to form filaments can be contained in a cell of the type conventionally used for dry spinning, or flash spinning can be used. The spun filaments can be taken up on conventional textile machinery. A conventional spin finish is usually applied to the filaments before they are taken up.

The diameter of the final fibres or filaments preferably corresponds to a weight of below 20 decitex per filament, for example in the range 2 to 15 decitex per filament. This is the decitex after stretching; if stretching is used, the decitex per filament after initial extrusion may be higher than the range quoted above. Stretching is carried out before crosslinking.

The linear copolymer is crosslinked after extrusion. The crosslinking can be effected by reaction into the backbone of the linear copolymer but preferably is effected by crosslinking through pendent groups provided by one or more of the monomers that have been polymerised to form the linear copolymer. The crosslinking can be ionic, for instance as a result of exposing the linear copolymer to any of the known ionic crosslinking agents, preferably polyvalent metal compounds such as polyvalent aluminium compounds, for example aluminium sulphate. Organic compounds may be used instead of inorganic compounds to provide the crosslinking.

Preferably however the crosslinking is covalent between pendent groups in the linear copolymer.

The covalent crosslinking generally arises as a result of the formation of ester, amide (or imide) or urethane groups by reaction with carboxylic acid groups after extruding the copolymer. Ester groups are preferred.

The reaction may be with an external crosslinking agent. Various systems for externally crosslinking the copolymer are described in EP-A-269393 and these can be used in the present invention. For example, the carboxyl-functional linear polymer can be crosslinked by a diisocyanate to form urethane crosslinks or by a polyamine such as ethylene diamine to form amide crosslinks or by a polyfunctional reagent containing hydroxyl and/or epoxide groups to form ester crosslinks. Preferably, however, the polymer is internally crosslinked by reaction between reactive groups within the extruded copolymer. Usually, the carboxylic groups act as one type of reactive group and are reacted with hydroxyl, epoxide, amino or blocked isocyanate groups. Particularly preferred systems are described in detail in EP-A-268498. In these systems the extruded copolymer is formed from a monomer blend comprising monomer that provides carboxylic acid monomer groups and monomer that provides hydroxyl groups that can react with the carboxylic acid groups to form ester crosslinkages that contain only carbon and oxygen atoms in the linkages, and these carboxylic and hydroxyl groups are reacted after extrusion to form the said crosslinkages. Generally the carboxylic acid groups are provided by acrylic acid or methacrylic acid and the hydroxyl groups are provided by allyl alcohol, an epoxide-substituted vinyl monomer such as glycidyl methacrylate or a hydroxyalkyl ester of a vinyl carboxylic acid such as 2-hydroxyethyl acrylate, 2-hydroxyethyl methacrylate, 2-hydroxypropyl methacrylate or 3-hydroxypropyl methacrylate or by vinyl alcohol groups. Alternative hydroxyl group-containing monomers are those of the formula $CHR^1=CR^2\text{-}Y\text{-}M_a\text{-}OH$, where $R^1$ is hydrogen or carboxy, $R^2$ is hydrogen or methyl, Y is 0, $CH_2O$ or COO, M is alkyleneoxy, for example ethyleneoxy or 1,2-propyleneoxy, and a is an integer greater than 1 and preferably at least 5, as disclosed in EP-A-397410. Alternatively, the comonomer can contain a primary or secondary amino group, for example 2-aminoethyl methacrylate, which reacts to form an amide crosslink, or it can contain an isocyanate group (which may need to be blocked to prevent crosslinking during extrusion), for example 2-isocyanatoethyl methacrylate, to form urethane crosslinks.

Reference should be made to EP-A-269393, EP-A-268498 and EP-A-397410 for a full disclosure of suitable materials and methods of extruding filaments and of crosslinking that can be used in the present invention. As stated above, heat-activated crosslinking is preferred. The temperature used to crosslink the fibres or filaments can for example be in the range 150° to 250° C., with the temperatures during extrusion and stretching of the filaments being lower than the crosslinking temperature, preferably at least 30° C. lower.

The dispersed solid particles are chosen to improve the properties of the fibre or filament; for example they may modify the absorption/retention characteristics of the fibre or filament, alter the bulk properties of the fibre or filament, such as its electrical conductivity or X-ray opacity, or may alter the ability of the fibre or filament to absorb chemicals.

The dispersed solid particles may for example be particles of inorganic salts, such as barium sulphate, of carbon, of oxides, such as silica or manganese dioxide, of naturally occurring mineral clays, such as kaolin, or of any other substantially water-insoluble solids than can be reduced in particle size by a sufficient degree and are chemically substantially non-reactive towards the aqueous solution of the copolymer.

According to one aspect of the invention the dispersed solid particles improve the absorbency and retention characteristics of the fibres or filaments for liquids. The absorbency can be measured by the free swell test, in which 0.5 g fibre is dispersed in 30 ml. aqueous liquid and left for 5 minutes. The aqueous liquid used is generally 0.9% by weight saline solution, which is generally absorbed to a extent similar to body fluids such as urine. The test can alternatively be carried out with either tap water or demineralised water, but the results quoted below are for 0.9% saline solution. For all absorbency measurements, the fibre is conditioned at 65% relative humidity and 20° C. before being tested. The dispersion is then filtered through a sintered Mark 1 funnel of pore size 100–160 microns and is left for 5 minutes or until it stops dripping. The amount of water filtered through the funnel is weighed and the weight of water absorbed by the fibres is calculated by subtraction.

In addition to the above test, the retention by the fibre or filament of the aqueous liquid (such as saline solution) after application of pressure is measured in the retention test by weighing the water expressed after application of pressure at about 3.4 KPa for 5 minutes or until dripping stops. The presence of solid particles in the fibres or filaments does not generally affect the free swell absorption of the fibres or filaments, but it may improve the absorption as measured by the retention test.

In a further test of absorption, the absorbency under load is measured by maintaining the fibres or filaments in contact with a 0.9% by weight saline solution for an hour while applying a load of 1.7 KPa. The presence of solid particles in the fibres or filaments may improve the absorbency under load as measured by this test.

A further absorbency/retention property which may be considered important in personal hygiene products is the dryness of the gel to the touch after it has absorbed an aqueous fluid. This may be measured by the following "wetback test", which is generally carried out following the free swell absorbency and retention test. The method consists of spreading a thin coating of swollen gel at its retention capacity evenly onto a 5cm×5cm square marked on a glass plate. A weighed tissue is then placed lightly in contact with the square of gel for 30 seconds. The weight of liquid picked up by the tissue is then determined, and the results converted to g/square cm of gel. The presence of solid particles in the fibres or filaments can improve the dryness of the gel as measured by the wetback test.

Dispersed solid particles which are effective in improving the absorbency and retention characteristics of the fibres or filaments include silica, which can for example be fumed or precipitated silica, a zeolite, for example a molecular sieve zeolite, or a mineral clay such as kaolin or bentonite.

The dispersed solid particles can alternatively be used to impart additional properties to the fibres or filaments. For example, the particles can be particles of an intumescent glass such as those sold by I.C.I under the Trademark "Ceepree". Fibres or filaments having a high water absorbency and intumescent properties can thereby be produced, and these can be formed into woven or nonwoven fabrics having a valuable combination of fire-resistant properties. In a fire such a fabric intumesces to an expanded char which acts as an insulating protective layer. If water is played on the fabric in an attempt to put out the fire the fibres or filaments absorb water to form a barrier layer which may prevent access of oxygen to the fire. Fibres or filaments containing dispersed intumescent glass can for example be used as a fire blanket or as a fire-protective upholstery fabric.

The dispersed solid particles can alternatively be particles of a material such as a zeolite having ability to absorb chemicals, so that the fibres or filaments have increased absorption of chemicals, for example increased odour absorption. Alternatively, particles of a zeolite having metal ions which confer antimicrobial properties, for example a zeolite containing copper, silver or zinc ions, can be used to form fibres or filaments having antimicrobial properties.

Alternatively, the dispersed solid particles can be particles of a heavy metal salt, for example barium sulphate, to give x-ray opaque fibres, or can be particles of an electrically conductive material such as carbon black to give electrically conductive fibres.

The proportion of particles in the fibre or filament is generally up to 10% by weight based on the dry weight of the copolymer. Usually, the proportion of particles is at least 1% by weight to achieve a significant effect. For many purposes the proportion of particles is up to 5% by weight, and preferably at least 1.5%, more preferably at least 2%. The size of the particles can for example be up to about 20 or 25 microns, more usually up to 15 microns. Whilst in general the size of the particles can be up to about half the diameter of the fibre or filament, a relatively low particle size, for example less than 10 microns and preferably less than 5 microns, is preferred when the proportion of particles in the fibre or filament is above 5% by weight. Particles of size less than 1 micron may be preferred, particularly for the purpose of improving the absorbency retention of the fibres or filaments or the strength or dryness of the gel formed when the fibres or filaments have absorbed an aqueous fluid.

Prior to extrusion (spinning), it is necessary to produce a dispersion of the solid particles in the aqueous solution of the copolymer. The dispersion can be prepared by mixing the solid particles with the copolymer solution, which optionally may be diluted with water to reduce the viscosity. The fine dispersion can be produced using standard dispersing techniques such as ball milling, bead milling, or high-shear stirring or ultrasonically. It may be preferred to produce the dispersion of the solid particles in the copolymer solution by a two-stage process. In this case a concentrated dispersion of the solid particles in water or in a dilute solution of the copolymer, for example a 5 to 20% by weight solution, is produced and this is subsequently mixed with the main copolymer solution to produce the final solution for extrusion (spinning). The aqueous dispersion of solid particles can conveniently be formed in a high-shear mixer. The mixing of the concentrated dispersion with the copolymer solution can be carried out using standard mixing techniques such as high-shear or low-shear mixing, ultrasonically or by pumping the mixture through a static mixer. It is preferable that the mixture be spun into fibres as soon as possible because there may be a tendency for the dispersed solid particles to agglomerate. It is preferable that the mixing be carried out continuously as part of the spinning process.

The polymer solution containing dispersed particles is capable of being converted into a variety of shaped forms such as fibres, filaments, fibrils, pulp, films, sheet or coatings, with evaporation of the solvent after shaping. The fibres or filaments produced can be further processed into milled fibres, chopped fibres, yarns, webs or woven, knitted or nonwoven fabrics.

The water-absorbent water-insoluble fibres or filaments of the present invention can be used in various products. They can, for example, be used in absorbent personal products such as tampons, disposable diapers, sanitary napkins or incontinence pads. The absorbent fibres or filaments are preferably used in combination with other fibres, for example cellulosic fibres such as cotton or regenerated cellulose fibres, including multi-limbed cellulose fibres as described in EP-A-301874, or polypropylene or polyester fibres. The absorbent fibres can be intimately mixed with said other fibres, for example by carding or air laying the fibres together to form a web of mixed fibres. Alternatively, the absorbent fibres or filaments can be used as a layer, for example a non-woven fabric, of absorbent fibres or filaments sandwiched between layers of other fibres. The proportion of absorbent fibres or filaments in a blend with cellulosic fibres for absorbent products can for example be at least 5% by weight and up to 95%, preferably at least 10% and up to 50%, by weight. The absorbent fibres or filaments can also be used at similar levels in conjunction with fluffed wood pulp or synthetic fibre pulp, for example polyolefin pulp, in absorbent products.

A yarn, woven fabric or nonwoven fabric comprising the absorbent fibres or filaments can be used as a swellable material which prevents ingress of water in underground cables. A yarn or fabric tape can be used to wrap cable or can be laid longitudinally in the cable.

The absorbent fibres or filaments can be used in many other applications of the types described in Research Disclosure, January 1992 at pages 60–61, for example in filters, absorbent liners or mats for packaging, disposable wipes, mats, shoe insoles or bed sheets, swellable gaskets or seals, moisture retention mats in horticulture, moisture-retaining packaging or swellable self-sealing stitching threads.

The invention is illustrated by the following Examples, in which parts and percentages are by weight unless otherwise stated:

EXAMPLE 1

A zeolite with an average particle size of less than 5 microns was dispersed in a 10% aqueous solution of a copolymer of acrylic acid, methyl acrylate and hexapropylene glycol monomethacrylate in a ratio of 60:35:5 using a ball mill to produce a paste containing 30% zeolite. 1 part of the paste was blended with 9 parts of a 40% solution of the copolymer using a barrel mixer. The mixture was directly extruded at 100° C. through a spinneret into a gaseous medium to form filaments containing 8% zeolite. The filaments were crosslinked by heating at 200° C. The crosslinked filaments exhibited an enhanced ability to absorb odours from an aqueous liquid compared to a control filament without added zeolite.

EXAMPLE 2

A commercially available dispersion of colloidal silica in water was mixed with the copolymer solution described in Example 1 in a barrel mixer and spun into fibres and crosslinked in the same manner. The resulting fibres, containing 2% silica, exhibited a high gel strength when swollen in water compared to a control fibre without silica.

EXAMPLE 3

39.4 g "Ceepree" intumescent glass particles of microfine grade (believed to be of particle size about 5 microns) were added to 300 g water and dispersed using a Silverson high-shear mixer for 2 to 3 minutes. This suspension was added to 4.5 kg of a 38% aqueous solution of a copolymer of 78 mole % acrylic acid (75% neutralised as sodium salt), 20 mole % methyl acrylate and 2 mole % hexapropylene glycol monomethacrylate. The suspension was added at 55° to 65° C. and stirred with a paddle stirrer. After 2 hours an evenly dispersed mixture was obtained, containing approximately 36% solids, with 2% Ceepree on polymer.

This dispersion was spun into filaments through a spinneret into a cell where water was evaporated from the filaments. The temperature of the dispersion at the spinneret was between 90° and 100° C. The cell was heated by tube wall heaters at 150° C. The filaments were taken up at approximately 200 m/min to give a fibre of approximately 15 dtex. Samples of the resulting multifilament tow were crosslinked by heating in air under the conditions mentioned below. The free swell absorbency and absorbency retention of the resulting fibres were measured in each case:

EXAMPLE 3(a)

10 minutes at 200° C.
Free swell 49.7 g/g, retention 35.1 g/g.
The gel was firm

EXAMPLE 3(b)

12 minutes at 200° C.
Free swell 42.4 g/g, retention 27.9 g/g.
The gel was firm

The fibre containing Ceepree showed a marked resistance to ignition compared to equivalent fibre without Ceepree. This was demonstrated by holding pads of fibre in a flame. The fibre containing Ceepree could be held in the flame indefinitely because of the formation of a protective char. The fibre behind the char showed no propensity to ignite. Fibre without Ceepree had increased fire resistance compared to most natural and synthetic fibres and was self-extinguishing on removal from the flame, but it burnt in the flame and shrank away from the flame. The combination of the intumescent filler and highly water-absorbent polymer in a fibre form shows advantages over either component alone, and could find application in fire barrier end uses.

EXAMPLE 4

31 g of finely particuled zeolite (Union Carbide XTG 40) was dispersed in 750 g water using a Silverson mixer. This was blended with the aqueous copolymer solution used in Example 3 to give a dispersion containing 2% zeolite on polymer. This dispersion was spun into filaments by the process of Example 3. Crosslinking was carried out by heating under the conditions mentioned below. The filaments were tested for free swell absorbency, retention of absorbency, absorbency under load and wetback using the tests described above, with the following results:

| | Crosslink time at 210° C. | Free Swell g/g | Retention g/g | Absorbency under load g/g | Wetback g/cm$^2$ |
|---|---|---|---|---|---|
| Example 4(a) | 8 mins | 41.0 | 26.7 | 23.0 | not tested |
| Example 4(b) | 10 mins | 38.0 | 24.4 | 22.0 | 0.009 |

The gels produced after swelling of the filaments in the absorbency tests were very dry to the touch and appeared firm. As a comparison, crosslinked filaments produced from the same copolymer solution without zeolite gave a result of 0.012 g/cm$^2$ in the wetback test. The filaments and the gels produced from them had no odour if treated with an amount of a simple ester such as methyl acrylate which caused a noticeable odour when applied to filaments containing no particles, indicating that the zeolite had retained its odour-absorbing properties for simple esters.

The results also indicate that the material keeps a high absorbency under load over a range of crosslinklng conditions.

EXAMPLE 5

30.08 g of Neosil GP (14–16 micron) silica was dispersed in 300g water using a Silverson mixer. This was mixed with the aqueous copolymer solution used in Example 3 to give a dope containing 2% silica on polymer. The dope was spun into filaments by the process of Example 3 and samples were crosslinked by heating under the conditions mentioned below and were tested as described in Example 4.

| | Crosslink time at 210° C. | Free Swell g/g | Retention g/g | Absorbency under load g/g | Wetback g/cm$^2$ |
|---|---|---|---|---|---|
| Example 5(a) | 6 mins | 47.3 | 37.2 | 26.4 | 0.012 |
| Example 5(b) | 8 mins | 44.1 | 28.3 | 21.3 | 0.009 |
| Example 5(c) | 10 mins | 43.3 | 27.1 | 23.2 | 0.014 |

-continued

| | Crosslink time at 210° C. | Free Swell g/g | Retention g/g | Absorbency under load g/g | Wetback g/cm$^2$ |
|---|---|---|---|---|---|
| Example 5(d) | 12 mins | 40.7 | 27.0 | 22.3 | 0.003 |

The filaments had high absorbency under load over a range of crosslinking conditions. All of the gels felt and appeared dry to the touch, with the 10 minutes and 12 minutes samples being particularly good. This observation is backed up by the low wetback result for the 12 minutes sample.

We claim:

1. A process for the production of a fibre or filament of a water-absorbent water-insoluble fibrous material having a matrix of a crosslinked copolymer formed from 50 to 95% by weight of ethylenically unsaturated carboxylic monomer in free acid form or in the form of a salt with ammonia, an amine or an alkali metal and 5 to 50% by weight of copolymerisable ethylenically unsaturated monomer, wherein the matrix contains 1 to 10% by weight dispersed solid water-insoluble particles of an inorganic material of particle size below 20 microns which is chemically substantially non-reactive with the matrix copolymer, said inorganic material being selected from the group consisting of inorganic salts and oxides, carbon, mineral clays, glasses and zeolites, the process comprising extruding a dispersion of the solid water-insoluble particles in an aqueous solution of the matrix copolymer in its noncrosslinked state through a spinneret into a gaseous environment to remove the water to form the fibre or filament, and subsequently crosslinking the copolymer.

2. A process according to claim 1, wherein the concentration of the copolymer in the aqueous solution is 30 to 45% by weight.

3. A process according to claim 1 comprising passing the dispersion through the spinneret at a temperature which is above 80° C. but below the boiling point of the copolymer solution.

4. A process according to claim 1, wherein the dispersion has a viscosity at 80° C. of at least 20,000 mPa.s.

5. A process according to claim 1, comprising heating the fibre or filament at a temperature in the range 150° to 250° C. to effect the crosslinking.

6. A process according to claim 1, comprising stretching the fibre or filament before effecting the crosslinking of the polymer.

7. The process according to claim 1, wherein the particle size of the dispersed particles is below 5 microns.

8. The process according to claim 1, wherein the dispersed particles are particles of an intumescent glass, whereby the fibre or filament is useful in forming a fire barrier layer.

9. The process according to claim 1, wherein the dispersed particles are particles of a zeolite, whereby the fibre or filament has increased ability to absorb odours.

10. The process according to claim 1, wherein the dispersed particles are selected from the group consisting of silica, a zeolite and a naturally occurring mineral clay, whereby the fibre or filament has improved absorption and retention characteristics for liquids.

11. The process according to claim 1, wherein the dispersed particles are present at 1.5 to 5% of the dry weight of the fibre or filament.

12. The process according to claim 1, wherein the copolymer matrix is crosslinked by ester crosslinks.

13. The process according to claim 12, wherein the copolymerisable ethylenically unsaturated monomer consists at least partly of a hydroxyl-functional or epoxide-functional comonomer, and the ester crosslinks are formed by reaction between carboxylic acid groups derived from the carboxylic monomer and hydroxyl or epoxide groups derived from the copolymerisable monomer.

* * * * *